US011680468B2

(12) United States Patent
Roessler et al.

(10) Patent No.: US 11,680,468 B2
(45) Date of Patent: Jun. 20, 2023

(54) MULTI-GUN CLUSTER CARRIER

(71) Applicant: GEODYNAMICS, INC., Millsap, TX (US)

(72) Inventors: Dennis Roessler, Fort Worth, TX (US); John Hardesty, Fort Worth, TX (US)

(73) Assignee: GEODYNAMICS, INC., Millsap, TX (US)

( * ) Notice: Subject to any disclaimer, the term of this patent is extended or adjusted under 35 U.S.C. 154(b) by 177 days.

(21) Appl. No.: 17/293,545

(22) PCT Filed: Nov. 5, 2019

(86) PCT No.: PCT/US2019/059760
§ 371 (c)(1),
(2) Date: May 13, 2021

(87) PCT Pub. No.: WO2020/112308
PCT Pub. Date: Jun. 4, 2020

(65) Prior Publication Data

US 2022/0003086 A1 Jan. 6, 2022

Related U.S. Application Data

(60) Provisional application No. 62/836,782, filed on Apr. 22, 2019, provisional application No. 62/771,388, filed on Nov. 26, 2018.

(51) Int. Cl.
*E21B 43/117* (2006.01)
*E21B 43/1185* (2006.01)
*E21B 43/119* (2006.01)

(52) U.S. Cl.
CPC ..... *E21B 43/117* (2013.01); *E21B 43/119* (2013.01); *E21B 43/1185* (2013.01)

(58) Field of Classification Search
CPC .. E21B 43/117; E21B 43/1185; E21B 43/119; E21B 43/112
See application file for complete search history.

(56) References Cited

U.S. PATENT DOCUMENTS

| | | | | |
|---|---|---|---|---|
| 4,140,188 | A * | 2/1979 | Vann | E21B 43/119 175/4.51 |
| 5,054,564 | A * | 10/1991 | Oestreich | E21B 43/117 175/4.6 |
| 9,562,421 | B2 * | 2/2017 | Hardesty | E21B 43/119 |
| 11,499,401 | B2 * | 11/2022 | Eitschberger | E21B 43/117 |
| 2006/0196665 | A1 | 9/2006 | LaGrange et al. | |

(Continued)

FOREIGN PATENT DOCUMENTS

WO 2018017104 A1 1/2018

OTHER PUBLICATIONS

International Search Report / Written Opinion dated Jan. 27, 2020 in related/corresponding PCT Application No. PCT/US2019/059760.

*Primary Examiner* — Daniel P Stephenson
(74) *Attorney, Agent, or Firm* — Morgan, Lewis & Bockius LLP

(57) ABSTRACT

A gun assembly for perforating a well, the gun assembly including a single carrier; a first gun cluster, the first gun cluster including first plural shaped charges; and a second gun cluster, the second gun cluster including second plural shaped charges. The first gun cluster and the second gun cluster are placed in the single carrier.

12 Claims, 10 Drawing Sheets

(56) References Cited

U.S. PATENT DOCUMENTS

| | | | | |
|---|---|---|---|---|
| 2010/0252323 | A1* | 10/2010 | Goodman | E21B 43/117 175/4.6 |
| 2010/0269676 | A1* | 10/2010 | Behrmann | E21B 43/117 89/1.15 |
| 2012/0247771 | A1 | 10/2012 | Black et al. | |
| 2014/0331852 | A1* | 11/2014 | Martinez | E21B 43/117 89/1.15 |
| 2016/0130903 | A1 | 5/2016 | Robertson et al. | |
| 2017/0052011 | A1 | 2/2017 | Parks et al. | |
| 2018/0135389 | A1 | 5/2018 | Sullivan | |
| 2018/0320490 | A1 | 11/2018 | Hess et al. | |
| 2019/0040722 | A1* | 2/2019 | Yang | E21B 43/11 |
| 2019/0376372 | A1* | 12/2019 | Hardesty | E21B 43/119 |
| 2022/0003086 | A1* | 1/2022 | Roessler | E21B 43/119 |

* cited by examiner

MULTI-GUN CLUSTER CARRIER

BACKGROUND

Technical Field

Embodiments of the subject matter disclosed herein generally relate to downhole tools for perforating operations, and more specifically, to a gun carrier that is configured to hold plural gun clusters.

Discussion of the Background

Oil and gas exploration typically involves drilling a well 100 to a desired depth H relative to the surface 110, as illustrated in FIG. 1, where an oil formation 102 is believed to be located. Then, a casing 104 is lowered into the well 100 for preventing the walls of the well 100 from collapsing. After the casing 104 has been installed, cement is pumped down to fix the casing to the walls of the well. However, the casing 104 is essentially a pipe that does not fluidly communicate with the oil formation 102, except for the most distal end of the casing. The most distal end of the casing, called herein the downstream end, is not enough for allowing the oil to enter the casing.

Thus, it is traditional to lower a gun cluster 120 into the well 100, with a wireline 122, to puncture the casing 104. The holes 106, typically formed into the distal end of the casing 104, would promote the movement of the oil 108 from the formation 102 into the bore of the casing 104. To be efficient, each gun cluster 120 includes plural shaped charges 124, which are fired for making the holes 106. Although FIG. 1 shows a single gun cluster, for efficiency purposes, the operator of the well 100 would lower at the same time plural gun clusters to make a large number of holes/perforations into the casing 104.

A gun assembly 200 that includes plural gun clusters 120 is shown in FIG. 2. FIG. 2 shows that each gun cluster 120 is attached to a corresponding sub 126 and each sub 126 is attached to an adjacent gun cluster 120 to form the gun assembly 200. The upstream and downstream ends of the gun assembly 200 are connected to corresponding end subs 128. FIG. 2 also shows that each gun cluster has its own plurality of shaped charges 124. Note that the term "upstream" indicates a direction toward a top head of the well while the term "downstream" indicates a direction toward a bottom toe of the well.

A gun cluster 120 and associated sub 126 are shown in more detail in FIG. 3. The sub 126 is attached with threads 128 to a carrier 130 of the gun cluster 120. The carrier 130 acts as an external housing for the shaped charges 124 and protects them from the fluid that is present in the well, around the gun cluster. Further, the carrier 130 protects the shaped charges 124 from pressure waves or debris generated by an adjacent gun cluster, when its shaped charges are fired. For these reasons, the carrier 130 is made to have no holes or ports in the lateral wall. A bore 132 of the carrier 130 is capped at one end 132A by its associated sub 126, and at the other end 1326 by another sub (not shown), that is associated with another gun cluster (not shown).

The shaped charges 124 are typically placed inside an inner housing 140, which is called a loading tube and the entire loading tube is placed within the bore 132 of the carrier 130. The sub 126 has a body 300 that holds a bulkhead 304 in such a way that the bulkhead closes a bore 302. The bulkhead 304 is also closing the upstream end of the bore 132 of the gun cluster 120 and prevents an increased pressure from an upstream gun cluster to propagate to the bore 132. The bulkhead 304 has an electrical contact 306 that transmits an electrical signal coming from the surface to the gun cluster, for example, to fire the shaped charges 124.

The sub 126 that is provided between every two adjacent gun clusters is not only expensive, but also adds to the length of the gun assembly. Neither of these characteristics are desired for well exploration. Thus, there is a need to provide a better gun assembly that has less subs.

SUMMARY

According to an embodiment, there is a gun assembly for perforating a well, and the gun assembly includes a single carrier, a first gun cluster, the first gun cluster including first plural shaped charges, and a second gun cluster, the second gun cluster including second plural shaped charges. The first gun cluster and the second gun cluster are placed in the single carrier.

According to another embodiment, there is a gun assembly for perforating a well, and the gun assembly includes a single pipe carrier and plural gun clusters placed in the single pipe carrier.

According to yet another embodiment, there is a method for deploying a gun assembly into a well, and the method includes placing plural gun clusters into a single tubular carrier, wherein the plural gun clusters form the gun assembly, fixing the plural gun clusters to the single tubular carrier, and lowering the gun assembly into the well.

BRIEF DESCRIPTION OF THE DRAWINGS

The accompanying drawings, which are incorporated in and constitute a part of the specification, illustrate one or more embodiments and, together with the description, explain these embodiments. In the drawings.

DETAILED DESCRIPTION

The following description of the embodiments refers to the accompanying drawings. The same reference numbers in different drawings identify the same or similar elements. The following detailed description does not limit the invention. Instead, the scope of the invention is defined by the appended claims. The following embodiments are discussed, for simplicity, with regard to a gun assembly having a single carrier that is tubular and is configured to receive plural gun clusters. However, the single carrier may have other cross-sections.

Reference throughout the specification to "one embodiment" or "an embodiment" means that a particular feature, structure or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment. Further, the particular features, structures or characteristics may be combined in any suitable manner in one or more embodiments.

According to an embodiment, a gun assembly is configured to have a single carrier in which plural gun clusters are located. This means that for a given number of gun clusters, there is a single carrier instead of having a carrier for each gun cluster. Each gun cluster is attached to the single carrier with a dedicated connecting mechanism. In this way, more gun clusters per length of the gun assembly may be provided for a same length of the gun assembly. In addition, time is saved in terms of connecting the carriers to the corresponding subs as there are now fewer connections to make. This will translate into a more efficient exploration of a given well.

Figure 1:
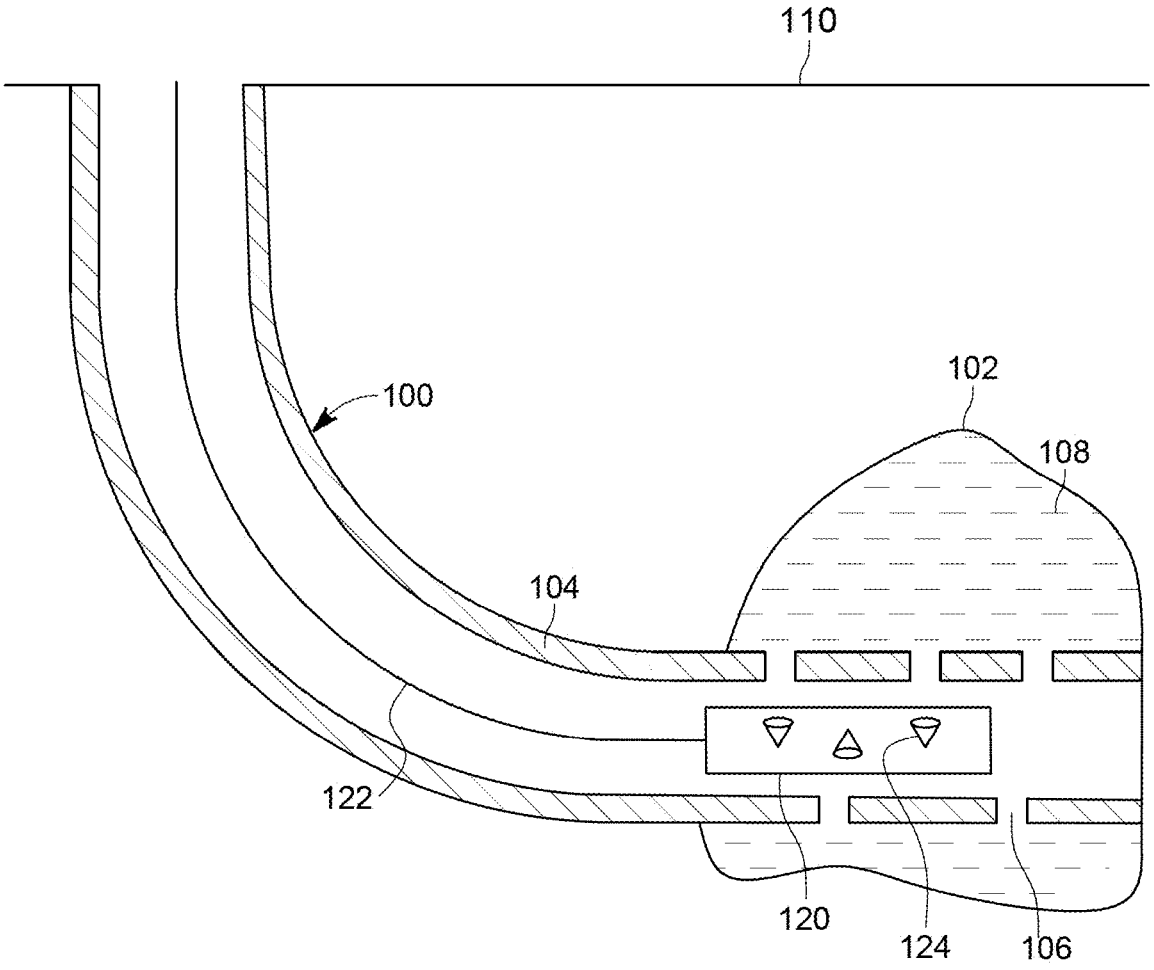
FIG. 1 (BACKGROUND ART)
FIG. 1 illustrates a well and associated equipment for well completion operations.
Figure 2:
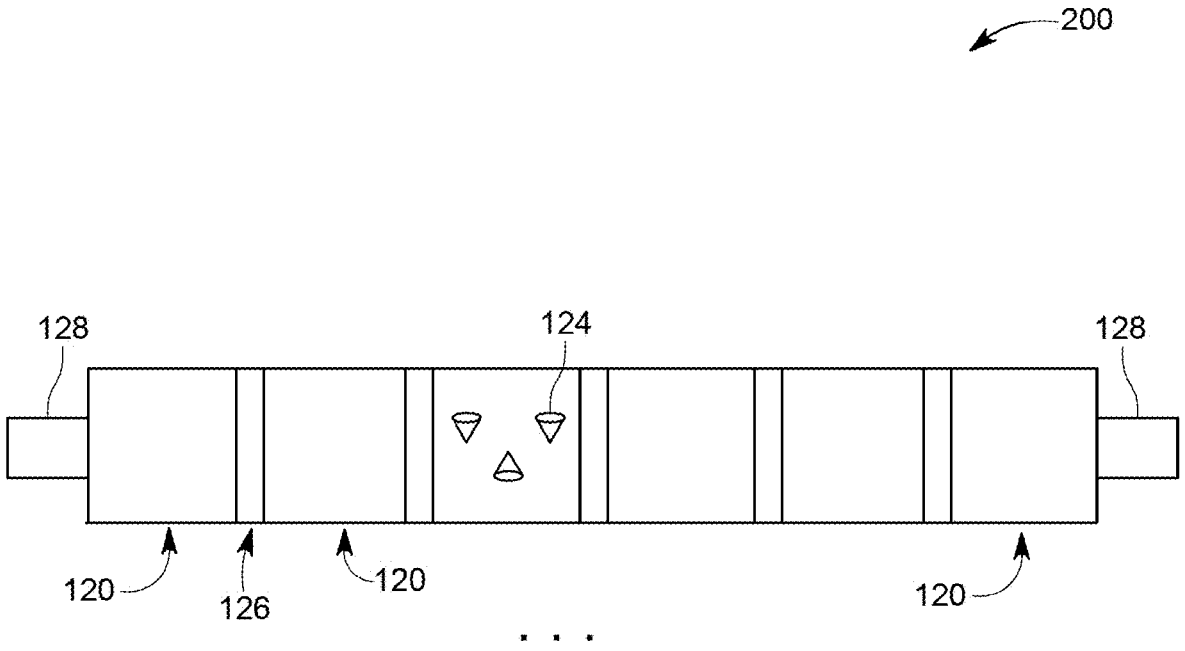
FIG. 2 (BACKGROUND ART)
FIG. 2 illustrates a gun assembly that is made of plural gun clusters connected with corresponding subs to each other.
Figure 3:
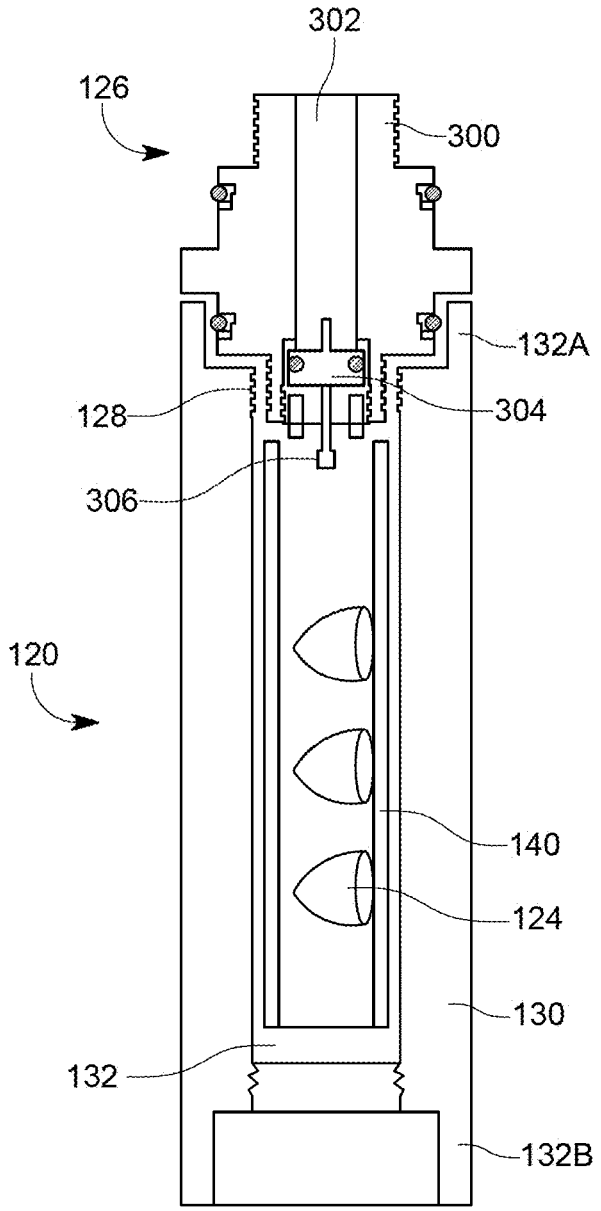
FIG. 3 (BACKGROUND ART)
FIG. 3 illustrates a gun cluster and associated sub.
Figure 4:
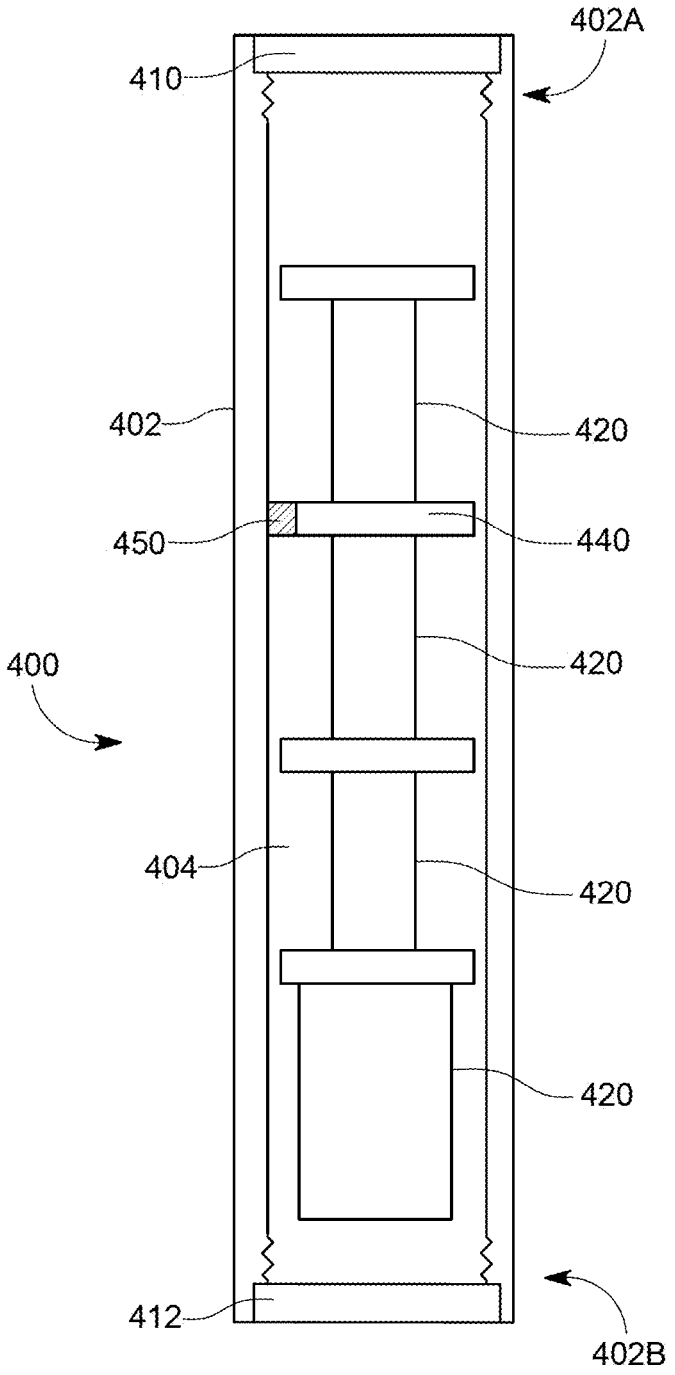
FIG. 4 illustrates a gun assembly that has plural gun clusters distributed inside a single carrier.

The novel gun assembly is now discussed with regard to the figures. FIG. 4 shows a gun assembly 400 that has a single carrier 402. In one application, the single carrier 402 is tubular, i.e., it is a single pipe. Inside a bore 404 of the carrier 402, two or more gun clusters 420 are located. A gun cluster 420 is connected to a corresponding sub 440 and a connecting mechanism 450 is provided for fixing the sub 440 relative to the carrier 402. An upstream end 402A of the carrier 402 may be closed with a cap or a sub 410 while a downstream end 402B of the carrier 402 may also be closed with a cap or a sub 412. If there is no other gun assembly to be attached to the gun assembly 400, then a cap is used to prevent a fluid from the well to enter into the bore 402. However, if a gun assembly or another gun assembly is attached to either end of the gun assembly 400, then a sub is used to achieve such connection. Regardless of whether a cap or sub is used for the upstream end 402A, it needs, at a minimum, to have an adaptor to communicate an electrical signal, from the surface, to a detonator for firing the shaped charges.

Figure 5:
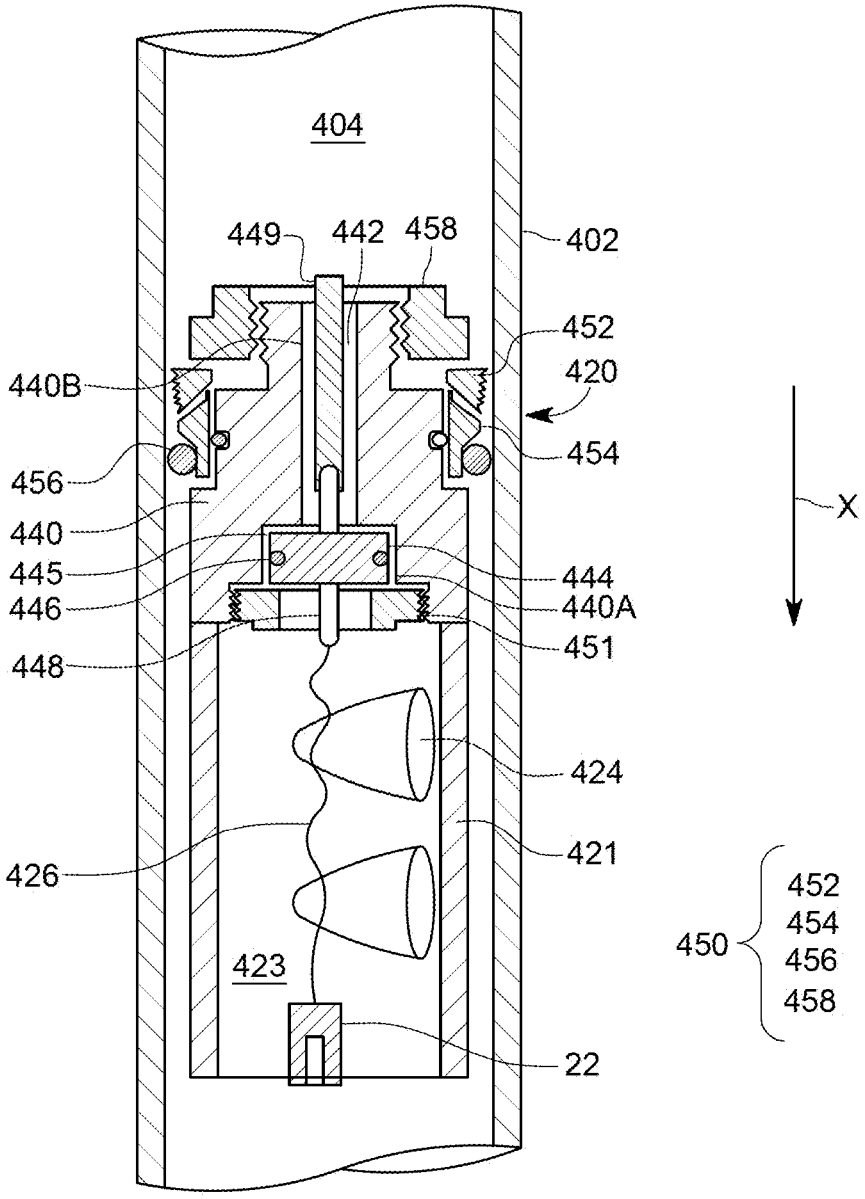
FIG. 5 illustrates a connecting mechanism for connecting a gun cluster to the single carrier.

The structure of a gun cluster 420 is now discussed with regard to FIG. 5. The gun cluster 420 is shown being positioned inside the bore 404 of the carrier 402. Only one gun cluster 420 is show in this figure for simplicity. However, as previously discussed, it is intended to position plural gun clusters inside the carrier 402. Gun cluster 420 has a loading tube 421 that holds the plural shaped charges 424. Any number of shaped charges 424 may be placed in the loading tube 421. Any type of shaped charges 424 may be used. The shaped charges 424 are connected to each other in this embodiment by a detonator cord 426, which is configured to ignite each shaped charge.

The loading tube 421 may be attached to or made integrally with a sub 440. Sub 440 has a bore 442 that is blocked at a downstream end 440A by a bulkhead 444. Bulkhead 444 is placed in a recess 445 formed in the sub 440. The recess 445 is in fluid communication with the bore 442. Bulkhead 444 may have one or more o-rings 446 located around an outside circumference, for sealing the bore 442 from the bore 423 of the loading tube 421. Bulkhead 444 is made from a strong material (for example, steel) so that it is capable to withstand a pressure experienced due to one or more detonations of shaped charges from an adjacent gun cluster. However, bulkhead 444 allows an electrical contact 448 to pass through. Electrical contact 448 is attached to the detonator cord 426 (or a detonator) and is configured to ignite the detonator cord, for firing the shaped charges 424. Bulkhead 444 may be fixedly attached to the body of the sub 440 with a nut 451. Other means for attaching the bulkhead to the body of the sub may be used. On the other side of the bulkhead 444, there is an extension tube 449 that electrically connects to another gun cluster (not shown) or an electrical wire (not shown) for transmitting the electrical signal from the surface to a desired gun cluster, or for transmitting electrical signals from the gun clusters to a global controller (not shown) placed at the surface of the well.

Figure 6:
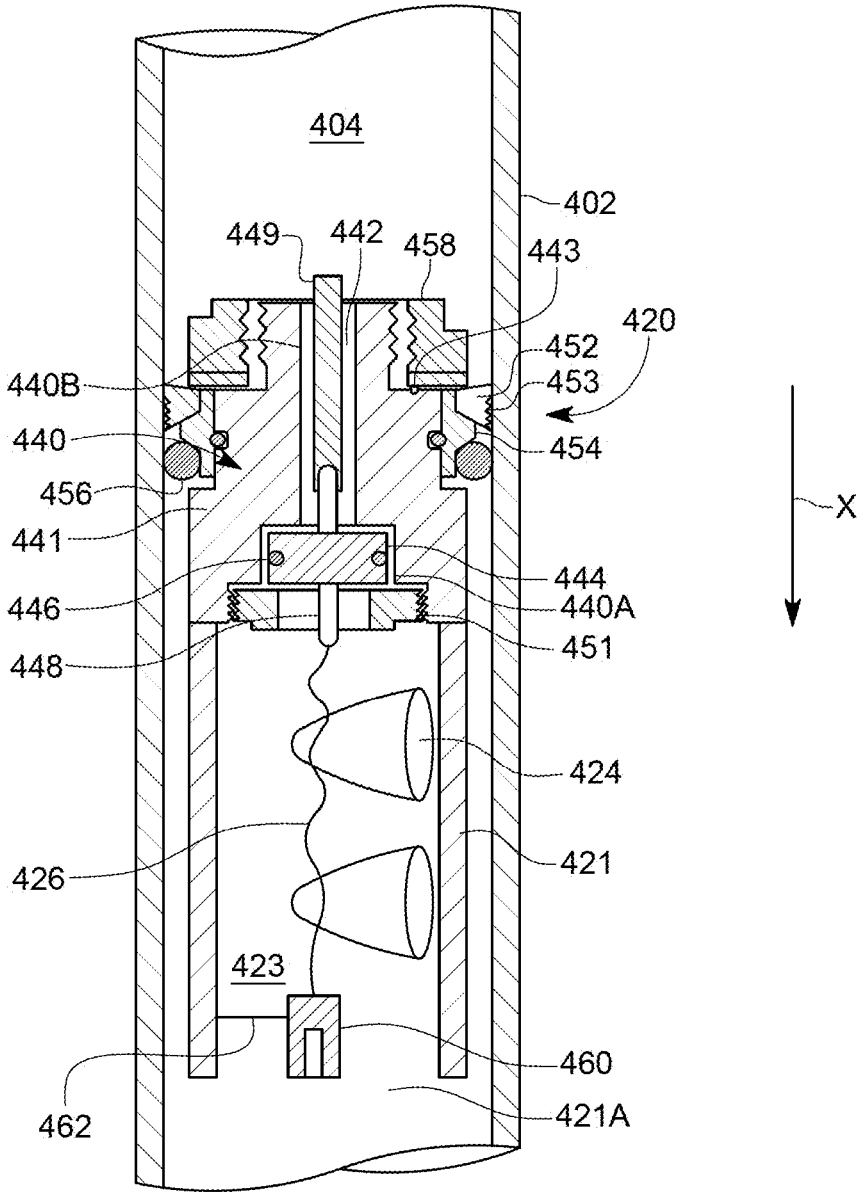
FIG. 6 illustrates the connecting mechanism after being activated.

To attach the loading tube 421 and the sub 440 to the carrier 402, a connecting mechanism 450 is used. FIG. 5 shows one implementation of the connecting mechanism 450. Other implementations may be used and a couple of different examples are discussed later. The connecting mechanism 450 includes, for this embodiment, one or more of a slip 452, a ramp 454, a seal 456, and a nut 458. The ramp is a circular element that has two inclined surfaces in cross-section. One of the inclined surface faces the slip and the other inclined surface faces the seal. Nut 458 is configured to attach with threads, to the upstream end of the sub 440. The nut 458 can be attached to the sub 440, for example, with a key from an upstream end of the carrier 402. When this happens, the nut presses downstream on the slip 452. This action moves the strip 452 against the ramp 454. As the ramp 454 moves in a downstream direction X, it presses the seal 456 outwardly, toward the inner surface of the carrier 402, as shown in FIG. 6. At the same time, the strip 452 is forces up the ramp and against the inner surface of the carrier 402. While the seal 454 seals the interface between the loading tube and the carrier, the slip 452 bites into the carrier and is fixed relative to the carrier. In this way, the connecting mechanism 450 fixes the sub 440 to a given location inside the carrier 402.

FIG. 6 shows the nut 458 being very close or touching a shoulder 443 of the body 441 of the sub 440, and the slip 452 being now sandwiched between the nut 458 and the ramp 454 so that a surface of the slip 452 is in contact with the interior surface of the carrier 402. Further, the surface of the slip 452 may be configured to have teeth 453 so that these teeth engage the interior surface of the carrier 402 and prevent the sub 440 and the gun cluster 420 from sliding inside the carrier 402. At the same time, due to the movement of the nut 458 along the X direction, the ramp 454 is squeezing the seal 456 (for example, it may be an o-ring) so that the seal 456 is pressed against the internal surface of the carrier 402. With this arrangement, a gun cluster 420 can be fixedly attached to the interior of the carrier 402, and a next gun cluster can then be lowered into the carrier, on top of the previous gun cluster, and then set in place by tightening the nut 458. The gun clusters 420 may be fixed anywhere inside the carrier 402.

To achieve an electrical contact between consecutive gun clusters, each gun cluster (except for the most bottom one) has an electrical connector 460, that is configured to mechanically and electrically engage a corresponding extension tube 449 from another gun cluster. The electrical connector 460 is fixedly placed in the bore 423 of the loading tube 421 by using, for example, a bracket 462. Note that the downstream end 421A of the loading tube 421 is open and is configured to seat on the sub 440 of the gun cluster below. In one application, a top portion of the sub of the next gun cluster fits directly into the loading tube of the gun cluster above.

Figure 7A:
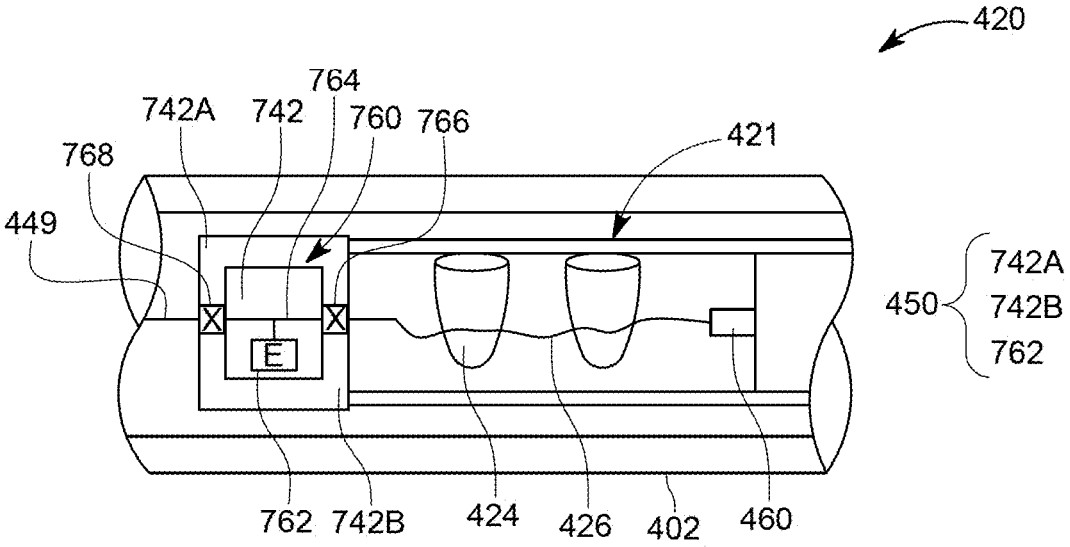
FIG. 7A illustrates another connecting mechanism for attaching a gun assembly to the single carrier.
Figure 7B:
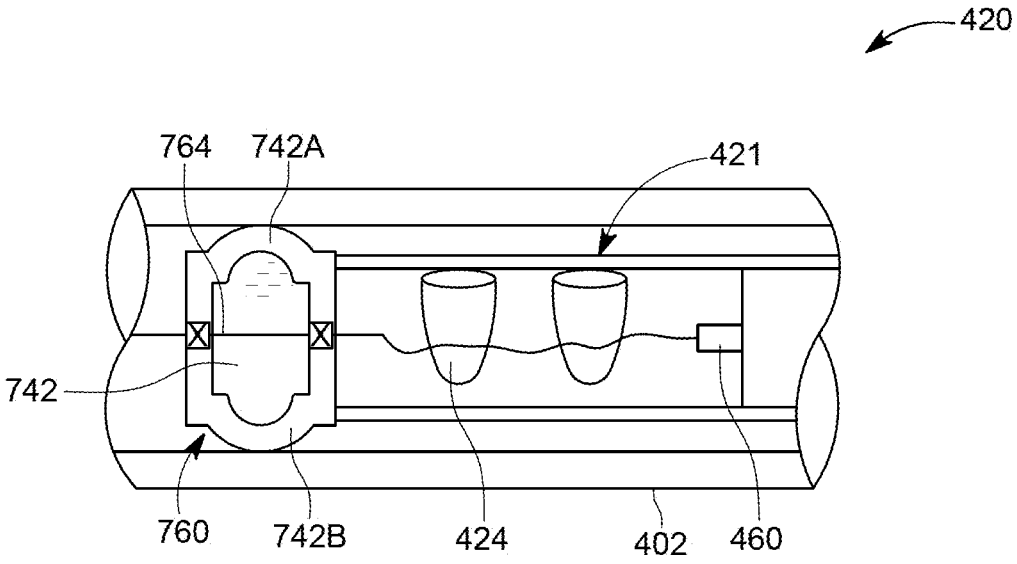
FIG. 7B illustrates the connecting mechanism after being activated.

FIGS. 7A and 7B illustrate another possible implementation of the connecting mechanism 450. FIG. 7A shows that the sub 460 of the embodiment illustrated in FIG. 4 is now replaced with a sub 760 that has an internal chamber 742. The side walls 742A and 742B of the internal chamber 742 are manufactured to be thinner than those of the sub 460 so that they can deform for the reasons discussed later. The internal chamber 742 houses an explosive charge 762, which is different from the shaped charges or a detonator that is used to initiate the firing of the shaped charges. The explosive charge 762 with the deformable side walls 742A and 742B constitute the connecting mechanism 450. Explosive charge 762 is electrically connected to a wire 764, which transmits one or more signals to and from a global controller located at the surface. Note that seals 766 and 768 close the internal chamber 742, at corresponding ports where the wire 764 enters and exits the chamber. These seals are strong enough (for example, made of metal, similar to the bulkhead 444 of the embodiment shown in FIG. 4) so that a pressure generated by the detonation of a shaped charge above or below the chamber 742, or a detonation of the charge 762, does not enter or exit the internal chamber 742.

Thus, for this embodiment, when the gun cluster 420 needs to be fixed to the interior of the carrier 402, a signal is transmitted to the charge 762 to fire. The signal may be transmitted along the wire 764. However, one skilled in the art would understand that the signal may also be an acoustic signal, or an optical signal, etc. and does not need to be communicated along the wire 764. When the charge 762 is fired, a pressure inside the internal chamber 742 suddenly increases because the seals 766 and 768 do not allow the gas inside the internal chamber to escape. Because the walls 742A and 742B are designed to be thinner and deform when a certain pressure inside the internal chamber is above a set value, the pressure generated by firing the charge 762 deforms these two walls and presses them against the carrier 402, as illustrated in FIG. 7B. This action fixes the sub 760 to the carrier 402 and thus, the cluster gun is now fixed in place inside the carrier. Note that the firing of the charge 762 is performed while the carrier 402 is at the surface, not in the well. For example, the firing of the charge 762 may be performed inside the manufacturing plant or a set up facility. Each additional gun cluster that is placed into the carrier 402 would be fixed to the carrier by the same procedure. Also note that the wire 764 is protected inside the internal chamber so that the firing of the charge 762 does not destroy its continuity as the wire 764 needs to be further used when the gun assembly is in the well. Thus, in one application, the wire 764 may be routed through a dedicated conduit formed in the walls of the internal chamber or thorough a conduit outside the internal chamber.

Figure 8:
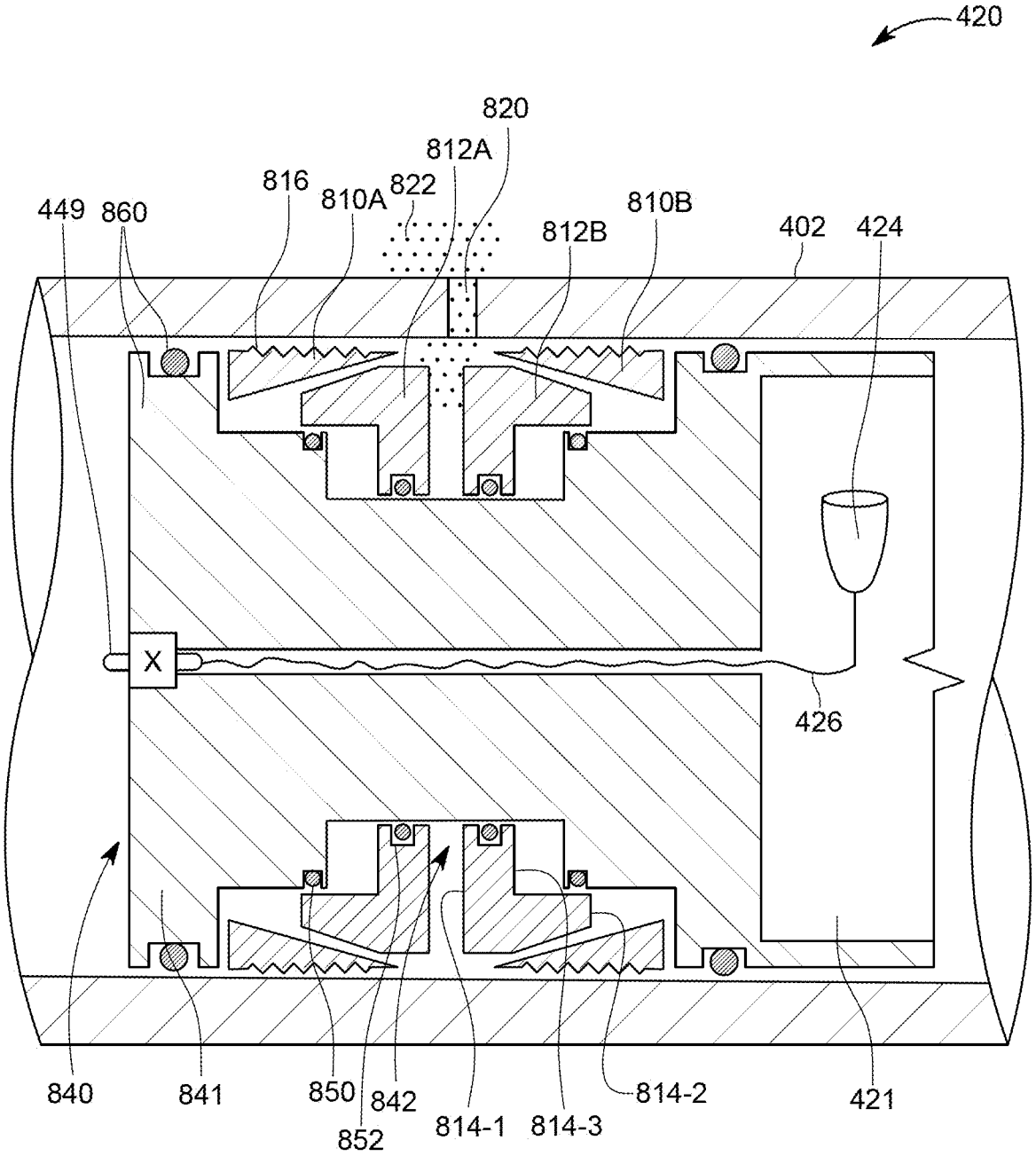
FIG. 8 illustrates still another connecting mechanism for attaching a gun assembly to the single carrier.

Another implementation of the connecting mechanism 450 is illustrated in FIG. 8. In this embodiment, the connecting mechanism 450 includes slips 810A and 810B, pistons 812A and 812B, and a port 820 formed through a wall of the carrier 402. The slips and the pistons are hosted in an outside recess 842 formed in the body 841 of a sub 840. The pistons 812A and 812B and the recess 842 have seals 850 and 852 so that a fluid 822 that enters the carrier 402 through port 820 can act only on faces 814-1 and 814-2, but not on faces 814-3 of the pistons 812A and 812B. Thus, when the external fluid 822 acts on faces 814-1 and 814-2, because faces 814-1 are larger than faces 814-2, the pistons 812A and 812B would move in opposite directions, away from each other and would act on slips 810A and 810B, respectively.

Figure 9:
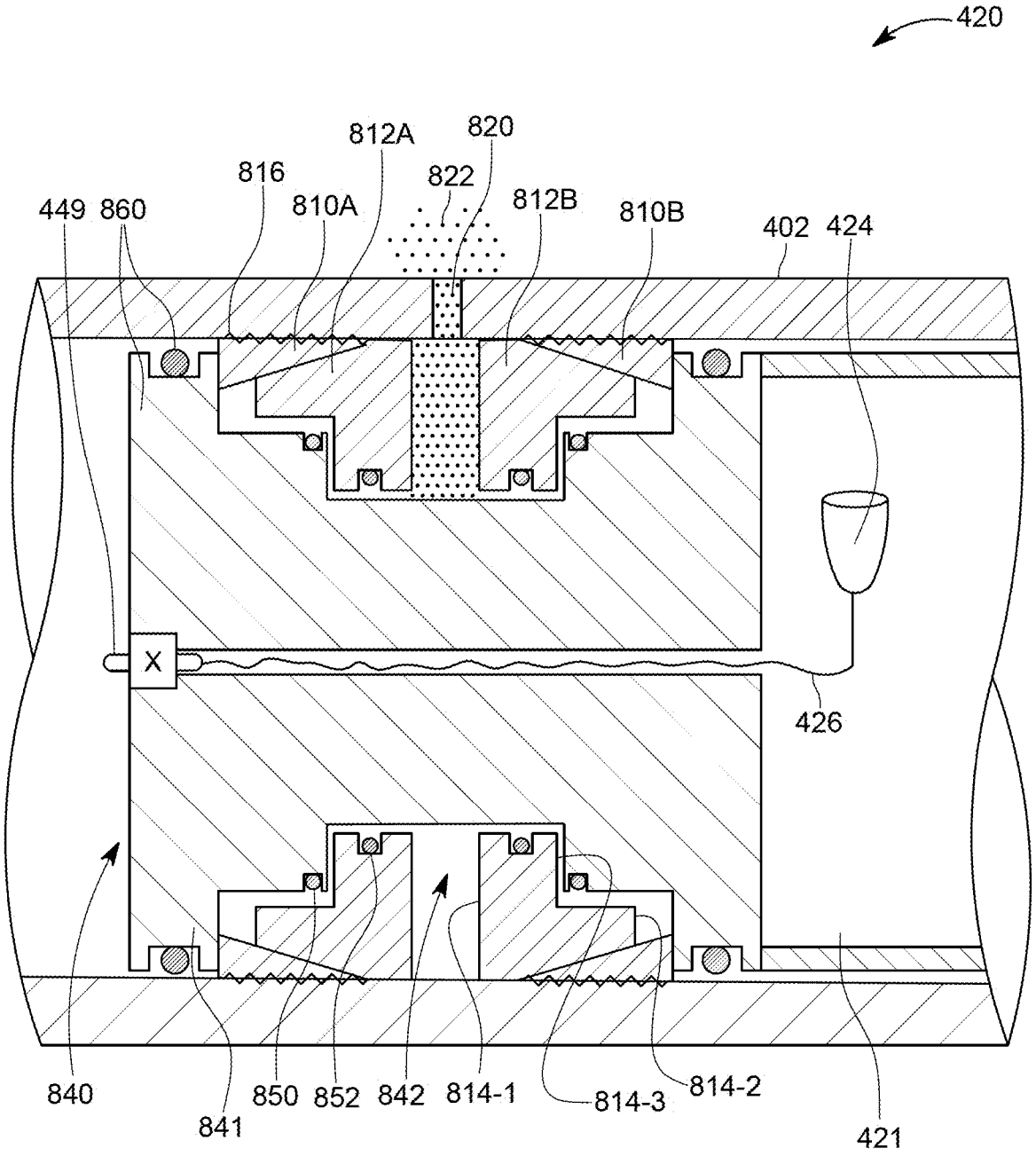
FIG. 9 illustrates the connecting mechanism after being activated.

Slips 810A and 810B may have teeth 816 on their faces facing the carrier 402 so that when pressed by the pistons 812A and 812B, they "bite" into the interior surface of the carrier 402, and fix the gun cluster 420 in place, as shown in FIG. 9. Further, FIG. 8 shows plural seals 860 placed on the body 841 of the sub to prevent the fluid 822 from moving past an interface formed between the sub 840 and the carrier 402. Thus, for this embodiment, there is no need for a key, as in the embodiment of FIGS. 5 and 6, and there is no need for an explosive charge, as in the embodiment of FIGS. 7A and 7B, for fixing the gun cluster to the casing. By simply exposing the port 820 to the high pressure fluid 822 that is present in the well, the pistons 812A and 812B are activated and the slips 810A and 810B automatically engage the carrier 402. Thus, for this embodiment, there is no need to send any command from the surface.

In one application, the slips (for example, in FIG. 5) could be designed such that the explosion of the shaped charges of the gun cluster sets them with minimal travel. In this application, the slips could be initially attached to a plate of the sub, and then, they would be separated and set by the explosion, or separated during installation and set by the explosion. The travel of the plate during setting could be less than 2 in, but preferably 0.1 to 0.5 in.

In another application, additionally devices, called "pin pullers" or "pin pushers," may be used. These devices, which are electrically actuated propellant or explosive devices, which either push or pull a pin, could be used on each plate to preset the slips, which would then be fully set by the gun detonation or the well pressure. The pin pullers could be actuated before any of the gun clusters are fired, or just before each appropriate gun cluster is fired. In yet another application, it is possible to key the interior of the carrier 402 and the sub of each gun cluster configured to engage a corresponding key.

Figure 10:
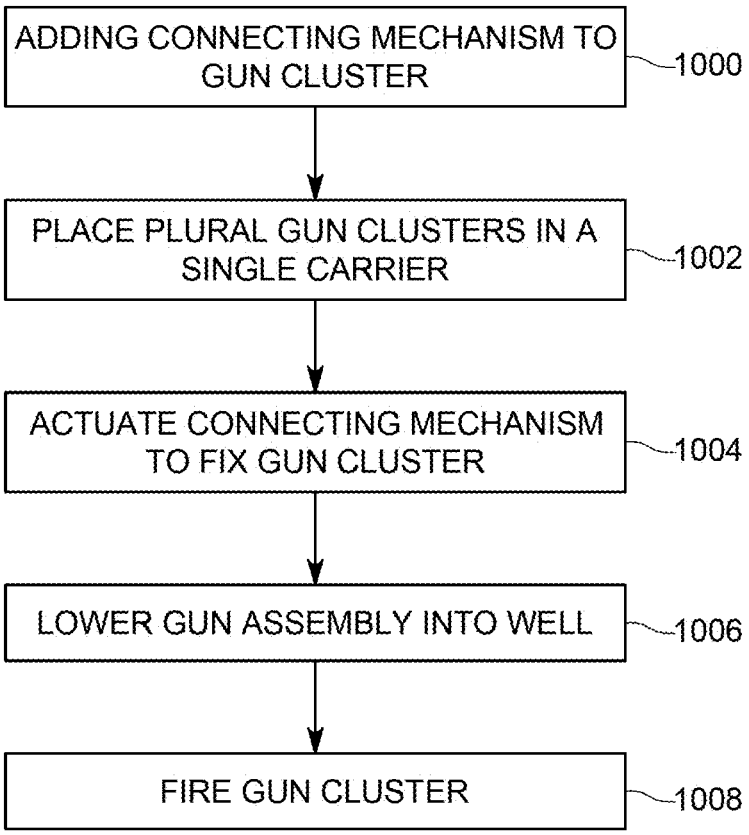
FIG. 10 is a flowchart of a method for attaching a gun cluster to a single carrier.

A method for setting up a gun assembly based on one of the above embodiments is now discussed with regard to FIG. 10. The method includes a step 1000 of adding a connecting mechanism 450 to a gun cluster 420. In step 1002, plural gun clusters 420 are provided inside a single carrier 402. In step 1004, the connecting mechanism 450 is actuated to fix each gun cluster to the single carrier. In step 1006, the gun assembly 440, which is formed by the plurality of gun clusters 420, is lowered into a well, and in step 1008, one or more of the gun clusters is fired. Note that the order of the steps can be changed, for example, step 1006 can be performed first and then step 1004.

While the various features illustrated above have been discussed in the context of the oil and gas industry, those skilled in the art would understand that the novel features are applicable to similar devices in any field. While many details of the gun clusters have been omitted for simplicity, one skilled in the art would know that a gun cluster may also include a detonator that initiates the firing of the shaped charges. Further, the gun cluster may also include a switch that is connected to electrical contact 448 or 449 and this switch is configured to ignite the detonator. The switch may be a digital or analog switch. A digital switch has associated electronics that can be selected by the global controller.

The disclosed embodiments provide methods and systems for delivering more shaped charges in a well for perforating the casing of the well. It should be understood that this description is not intended to limit the invention. On the contrary, the exemplary embodiments are intended to cover alternatives, modifications and equivalents, which are included in the spirit and scope of the invention as defined by the appended claims. Further, in the detailed description of the exemplary embodiments, numerous specific details are set forth in order to provide a comprehensive understanding of the claimed invention. However, one skilled in the art would understand that various embodiments may be practiced without such specific details.

Although the features and elements of the present exemplary embodiments are described in the embodiments in particular combinations, each feature or element can be used alone without the other features and elements of the embodiments or in various combinations with or without other features and elements disclosed herein.

This written description uses examples of the subject matter disclosed to enable any person skilled in the art to practice the same, including making and using any devices or systems and performing any incorporated methods. The patentable scope of the subject matter is defined by the claims, and may include other examples that occur to those skilled in the art. Such other examples are intended to be within the scope of the claims.

What is claimed is:

1. A gun assembly for perforating a well, the gun assembly comprising:
- a single carrier;
- a first gun cluster comprising:
  - first plural shaped charges;
  - a sub;
  - a connecting mechanism comprising:
    - a slip;
    - a ramp having first and second inclined surfaces; and
    - a seal configured to fluidly separate an upstream part of the carrier from a downstream part of the carrier for attaching the sub to the single carrier;
    - wherein the slip is facing the first inclined surface of the ramp and the seal is facing the second inclined surface of the ramp; and
  - a carrier tube connected to the sub,
  - wherein the carrier tube hosts the first plural shaped charges; and
- a second gun cluster, the second gun cluster including second plural shaped charges,
- wherein the first gun cluster and the second gun cluster are placed in the single carrier.

2. The gun assembly of claim 1, further comprising:
- a nut that forces the slip up the ramp and against the carrier when the nut is threaded to the sub.

3. The gun assembly of claim 2, wherein the nut also forces the seal up the ramp and against the carrier when the nut is threaded to the sub.

4. The gun assembly of claim 1, wherein a sub of the second gun cluster is configured to directly fit into a loading tube of the first gun cluster.

5. A gun assembly for perforating a well, the gun assembly comprising:
- a single carrier;
- a first gun cluster comprising:
  - first plural shaped charges;
  - a sub;
  - a connecting mechanism comprising
  - a detonation charge located in an internal chamber of the sub; and
  - a carrier tube connected to the sub,
  - wherein the carrier tube hosts the first plural shaped charges; and
- a second gun cluster, the second gun cluster including second plural shaped charges,
- wherein the first gun cluster and the second gun cluster are placed in the single carrier.

6. The gun assembly of claim 5, wherein the detonation charge is sized to deform outwardly, when fired, side walls of the sub to contact the carrier.

7. The gun assembly of claim 5, further comprising:
- an electrical connection attached to the detonation charge for firing the detonation charge.

8. A gun assembly for perforating a well, the gun assembly comprising:
- a single carrier;
- a first gun cluster comprising:
  - first plural shaped charges;
  - a sub;
  - a connecting mechanism comprising:
    - two pistons; and
    - two slips; and
  - a carrier tube connected to the sub,
  - wherein the carrier tube hosts the first plural shaped charges; and
- a second gun cluster, the second gun cluster including second plural shaped charges,
- wherein the first gun cluster and the second gun cluster are placed in the single carrier.

9. The gun assembly of claim 8, wherein the two pistons and the two slips are provided in an external recess of the sub.

10. The gun assembly of claim 8, wherein the single carrier has a port that allows a fluid from outside the single carrier to enter between the two pistons.

11. The gun assembly of claim 10, wherein the two pistons are configured to move away from each other when the fluid enters through the port, and a movement of the two pistons forces the slips against an internal surface of the single carrier to fix the first gun cluster against the single carrier.

12. A gun assembly for perforating a well, the gun assembly comprising:
- a single pipe carrier; and
- plural gun clusters placed in the single pipe carrier and attached to an internal surface of the single pipe carrier with a connecting mechanism comprising
- a detonation charge placed in an internal chamber of a sub or two pistons and two slips disposed in an outside recess of a sub.

* * * * *